United States Patent [19]

Iten

[11] Patent Number: 4,587,730

[45] Date of Patent: May 13, 1986

[54] SLEEVE FOR DISPOSABLE SAFETY RAZOR

[75] Inventor: Clemens A. Iten, Staunton, Va.

[73] Assignee: American Safety Razor Company, Verona, Va.

[21] Appl. No.: 641,429

[22] Filed: Aug. 17, 1984

Related U.S. Application Data

[63] Continuation of Ser. No. 307,326, Sep. 30, 1981, abandoned.

[51] Int. Cl.[4] ..... B26B 21/00

[52] U.S. Cl. ..... 30/90; 30/32

[58] Field of Search ..... 30/32, 40.2, 85, 90, 30/1, 84

[56] References Cited

U.S. PATENT DOCUMENTS

| | | | |
|---|---|---|---|
| 2,342,207 | 2/1944 | McVey | 30/90 X |
| 2,525,569 | 10/1950 | Vogel | 30/84 X |
| 2,636,264 | 4/1953 | Ganzer | 30/90 |
| 2,654,149 | 10/1953 | Bowen et al. | 30/84 X |
| 3,177,582 | 4/1965 | Curtis | 30/90 |
| 3,287,803 | 11/1966 | Wauters | 30/90 X |
| 3,530,574 | 9/1970 | Patterson | 30/90 |
| 4,212,103 | 7/1980 | Schuman-Hoole | 30/32 X |
| 4,309,821 | 1/1982 | Terry et al. | 30/32 X |
| 4,432,136 | 2/1984 | Taylor | 30/32 X |

*Primary Examiner*—E. R. Kazenske
*Assistant Examiner*—Willmon Fridie, Jr.
*Attorney, Agent, or Firm*—Wender Murase & White

[57] ABSTRACT

A sleeve for a safety razor having a handle with a blade-carrying head pivotably attached thereto includes a body portion generally elliptical in cross-section formed by two inwardly-curved opposing side walls joined along one pair of opposing edges by a flat top wall with an aperture between the other pair of opposing edges, further including flanges connected to the edges of the side walls adjacent the aperture and a set of tabs extending laterally from the outer surface of one of the curved side walls. In use, the sleeve is slid over the razor head and held in place by engagement of the flanges with the portion of the handle extending through the aperture. When a plurality of sleeve-bearing razors are stacked vertically atop one another such as during shipping, storage or sale, the tabs interlockingly engage the handle portion of the adjacent razor and thereby prevent premature removal of the sleeves from the razors.

7 Claims, 5 Drawing Figures

SLEEVE FOR DISPOSABLE SAFETY RAZOR

This application is a continuation of application Ser. No. 307,326, filed Sept. 30, 1981, now abandoned.

BACKGROUND OF THE INVENTION

1. Field of the Invention

The present invention relates generally to sleeves for razors and, in particular, to a protective sleeve for a disposable safety razor.

2. Description of the Prior Art

It has long been recognized that it is desirable to cover the blade-carrying heads of safety razors, both to protect users from inadvertent and accidental injury from the exposed blade, as well as to protect the blade, itself, from nicks or other damage. In general, prior art devices intended to satisfy these objects have consisted of a protective cover secured directly to the razor head by a resilient clip or similar means. Covers of this sort are disclosed in U.S. Pat. Nos. 2,636,264, 3,172,202, 3,388,468 and 3,399,455.

All of these prior art devices are similar in that the protective cover is secured to the blade-carrying head, itself. While this may be acceptable for razors having blade-carrying heads rigidly affixed to the razor handle, such covers cause additional problems with regard to the newer disposable safety razors which have blade-carrying heads pivotably attached to the razor handle. In general, the pivotable head is provided with a spring made of a resilient plastic facilitating movement of the head from a neutral detent position in response to varying loads on the blade. Unfortunately, the plastic used in such springs is susceptible to "creep", i.e., taking a permanent set when the head is moved to a particular position for an extended period of time, which renders the spring action partially or completely ineffective. Accordingly, securing a cover to the head, itself, does not protect the pivoting feature of the safety razor which is an essential and desirable feature of disposable razors.

Furthermore, disposable razors of the type described above are generally sold in multiple packages in which one razor is stacked atop another. So as to prevent premature removal of a sleeve from one of the razors during shipping, display or sale, and thereby risking injury from the exposed blade, it is desirable to provide some means for locking the sleeve in place within the stacked razors such as by engaging the sleeve of one razor with the adjacent razor. To date, however, none of the prior art shields for razors includes a protective feature of this type.

SUMMARY OF THE INVENTION

An object of the present invention, therefore, is to construct a sleeve for protecting the blade-carrying head and pivoting mechanism of a disposable safety razor by securing the sleeve to the rigid handle of said razor without loading the blade-carrying head.

Another object of the present invention is to construct a sleeve for disposable safety razors in which tabs are provided on the sleeve to engage the adjacent razor when said razors are stacked, thus preventing premature removal of a sleeve from one of the stacked razors while also limiting movement of one razor relative the other.

An additional object of the present invention is to construct a sleeve for a disposable safety razor which can be easily and simply placed on or removed from the razor.

Further objects of the present invention will become apparent in the full description of the invention and drawings as set forth below.

The present invention is summarized in that a sleeve for a disposable safety razor having a handle with a blade-carrying head pivotably attached thereto includes a body portion generally elliptical in cross-section formed by two inwardly-curved opposing side walls joined along one pair of opposing edges by a flat top wall with an aperture between the other pair of opposing edges, further including flanges connected to the edges of said curved side walls adjacent the aperture and a set of tabs extending laterally from the outer surface of one of said curved side walls. In use, the sleeve is slid over the blade-carrying head of the razor so as to fully envelope the head within the interior of the sleeve with the handle of the razor extending through the aperture. The sleeve is thereby held in position on the razor by engagement of the flanges adjacent the aperture with the portion of the razor handle extending therethrough. In stacking a plurality of sleeve-bearing razors one on top the other, the tabs extending laterally from the outer surface of one of the curved side walls of the sleeve of a first razor engage the handle of the adjacent razor approximate the region where said handle protrudes through the aperture of the sleeve, thus interlocking the sleeves and razors so as to prevent premature removal of a sleeve from one of the stacked razors as well as limiting movement of adjacent razors relative each other.

DESCRIPTION OF THE PREFERRED EMBODIMENTS

Figure 1:
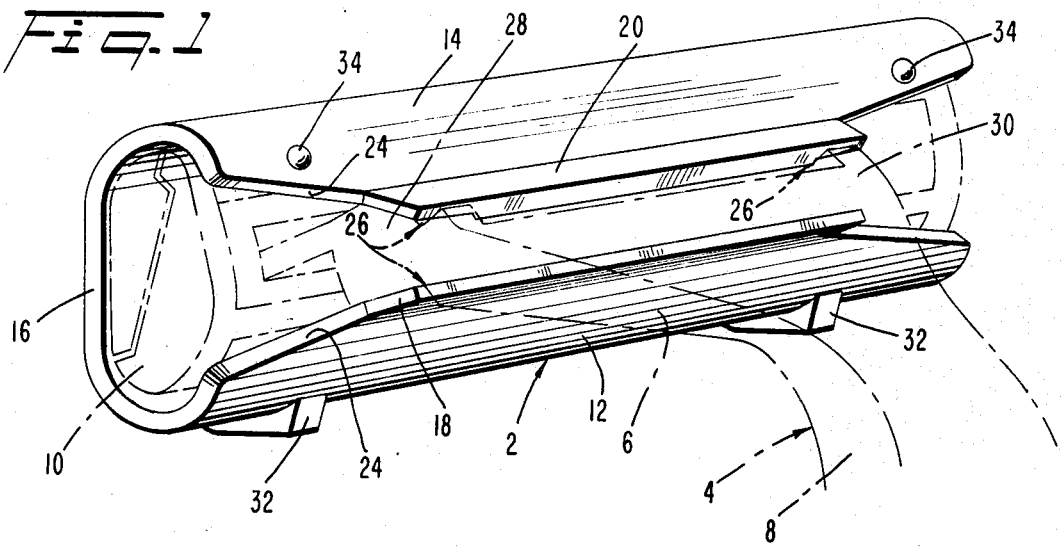
FIG. 1 is a perspective view of a preferred embodiment of a sleeve for a disposable safety razor in accordance with the present invention.

A preferred embodiment of a sleeve for a disposable safety razor according to the present invention is shown in FIG. 1 in perspective view. The sleeve 2 is shown in place on a razor 4 including an arm which connects the handle portion 8 of safety razor 4 to the pivotable blade-carrying head 10. The razor 4 is indicated by dashed lines for purposes of clarity.

Figure 2:
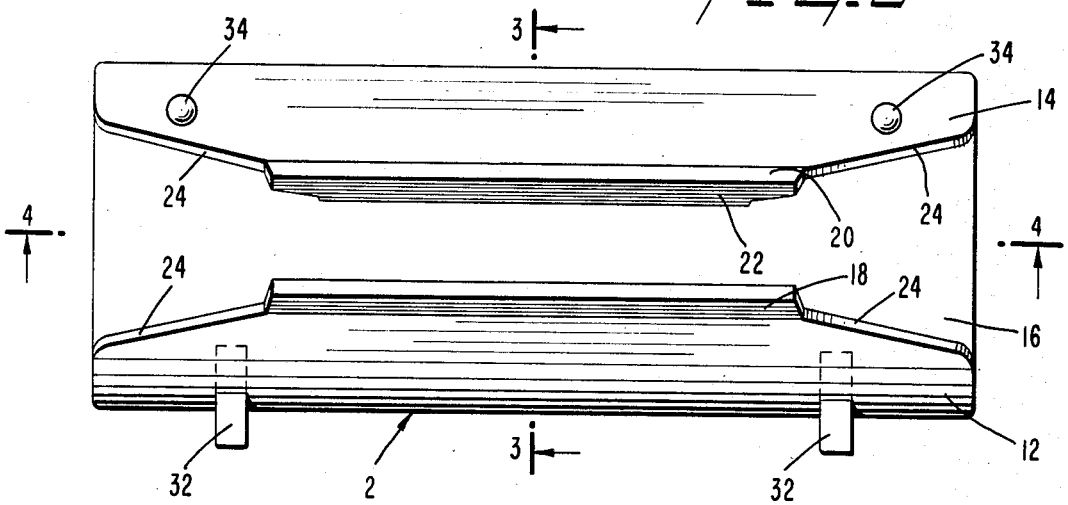
FIG. 2 is a bottom elevational view of the sleeve of FIG. 1.
Figure 3:
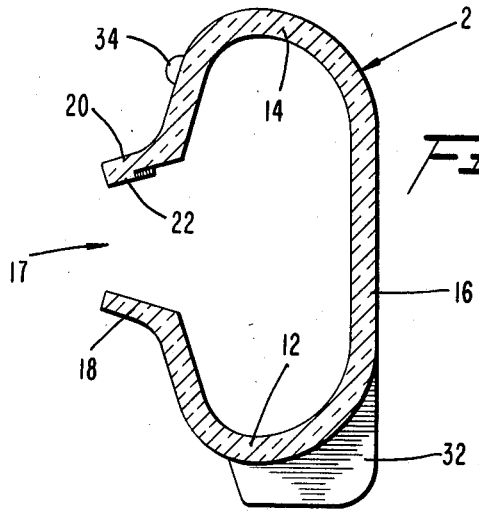
FIG. 3 is a cross-sectional view of the sleeve of FIG. 2 taken along lines 3—3.

The overall geometry of the sleeve 2 can best be understood with reference to FIGS. 2 and 3. The sleeve 2 is formed by two inwardly-curved opposing side walls 12 and 14 joined along one pair of opposing edges by a flat top wall 16 which has a width approximately equal to the width of the blade-carrying head 10. Thus, the combination of curved side walls 12 and 14 with flat top wall 16 lends a generally elliptical shape to the interior portion of sleeve 2, as best illustrated in FIG. 3. This elliptical shape corresponds generally to the cross-sectional shape of blade-carrying head 10 of razor 4 so that the head 10 will freely fit within the interior of sleeve 2;

however, it should be recognized that the specific geometry of the walls of the sleeve 2 can be adapted to accommodate blade-carrying heads of different cross-sectional dimension than that shown in FIG. 1.

While curved side walls 12 and 14 are each connected along one opposing edge to planar top wall 16, the other opposing edges are not joined, thus forming an aperture 17 therebetween. This aperture 17 is further defined by two angled flanges 18 and 20 connected, respectively, to said other opposing edges of curved side walls 12 and 14. Accordingly, the shape of the aperture 17 defined by said curved side walls 12 and 14 together with angled flanges 18 and 20 corresponds generally to the cross-sectional shape of arm 6 of safety razor 4.

In a preferred embodiment, sleeve 2, including flat top wall 16, curved side walls 12 and 14, and angled flanges 18 and 20, is made as a unitary piece of a resilient plastic by means of heat molding, injection molding or the like. Alternately, the sleeve can be constructed of individual pieces corresponding to said top wall, curved side walls and flanges, or in any combination thereof so as to collectively form a sleeve having resilient properties in the region of said angled flanges 18 and 20. When the sleeve is fitted onto a razor in the manner described in further detail hereinbelow, the sleeve 2 is secured on the razor 4 by engagement of the razor arm 6 by the resilient flanges 18 and 20 adjacent the aperture 17. To further assist in providing a secure engagement with the razor arm, a rib 22 is provided on the interior surface of flange 20; the particular function of rib 22 is also described in further detail hereinbelow.

As mentioned above, the width of sleeve 2, as defined by planar top wall 16, corresponds generally to the width dimension of blade-carrying head 10. Similarly, the width of flanges 18 and 20 correspond to the width dimension of arm 6 of the safety razor 4. Thus, edges 20 of curved side walls 12 and 14 are tapered to provide a smooth transition intermediate the larger dimension of planar top wall 16 and the smaller dimension of flanges 18 and 20. Tapered edges 20 also serve to centrally position the razor arm 6 into the sleeve aperture 17 when the sleeve is being fitted onto a razor 4.

As shown in FIGS. 1–3, a pair of tabs 32 are provided on the exterior surface of curved side wall 12 extending laterally from side wall 12 and flush with the surface of top planar wall 16. These tabs 32 are positioned symetrically about the transverse median of sleeve 2 and are spaced from each other a distance corresponding to the width dimension of arm 6 of razor 4. In addition, a pair of nipple-shaped projections 34 are provided on the exterior surface of curved side wall 14 opposite the planar body portion 16. Like tabs 32, protrusions 34 are also positioned symetrical the transverse median of sleeve 2.

Tabs 32 and protrusions 34 serve to interlock razors fitted with sleeves according to the present invention when said razors are stacked vertically atop each other; this is described in greater detail hereinbelow. Both tabs and protrusions alike may be integrally formed with the sleeve when constructed as a unitary device. It should be appreciated, however, that either element may be formed separately from said sleeve and later secured thereto by means of glue, heat bonding or the like.

The use of a sleeve according to the present invention on a disposable razor will now be described in detail. Sleeve 2 is intended for use with disposable safety razors of the type disclosed in U.S. patent application Ser. No. 252,084, filed Apr. 8, 1981, by the present applicant together with David O. Chase, entitled "Design for a Disposable Safety Razor" and herein incorporated by reference. As shown generally in FIG. 1, the arm 6 of the razor 4 connects the pivotable blade-carrying head 10 with handle 8 and is generally triangular in shape, tapered from the larger width dimension of head 10 to the smaller dimensions of handle 8. Furthermore, the forward end of each side of arm 6 proximate the head 10 is provided with a strut, designated by reference characters 28 and 30, respectively, which connects the arm to the blade-carrying head. Across both outer surfaces of the two struts 28 and 30 runs a single channel or groove 26.

In use, sleeve 2 is positioned onto the safety razor 4 by locating one end of blade-carrying head 10 within the sleeve and then sliding the sleeve onto the head so as to ultimately completely envelope the head within the interior of the sleeve. In so doing, razor arm 6 is centrally positioned and directed into the aperture 17 by means of the tapered edges 24 of the curved side walls 12 and 14. Flanges 18 and 20 simultaneously engage the side of arm 6 along the channel 26 provided in struts 28 and 30. Accordingly, the rear wall of the channel serves to prevent the flanges of the sleeve from slipping further down the arm, which would cause the blade-carrying head to contact the interior surface of the sleeve. Engagement of the flanges with the channel also serves to guide the sleeve as it is being slid into place on the razor.

Due to the resilient nature of flanges 18 and 20, sleeve 2 is secured to safety razor 4 merely by this engagement of the flanges with the razor arm; no contact is made between blade-carrying head 10 and sleeve 2. Thus, sleeve 2 does not preload the pivotable blade-carrying head which, if such a condition were to be continued for a prolonged period, would result in permanently deforming the biasing spring providing the pivoting action and rendering said pivoting action ineffective. Instead, sleeve 2 only contacts arm 6 which is rigidly connected to razor handle 8, thereby transmitting any load or pressure exerted on the sleeve onto the rigid razor arm and handle.

Figure 4:
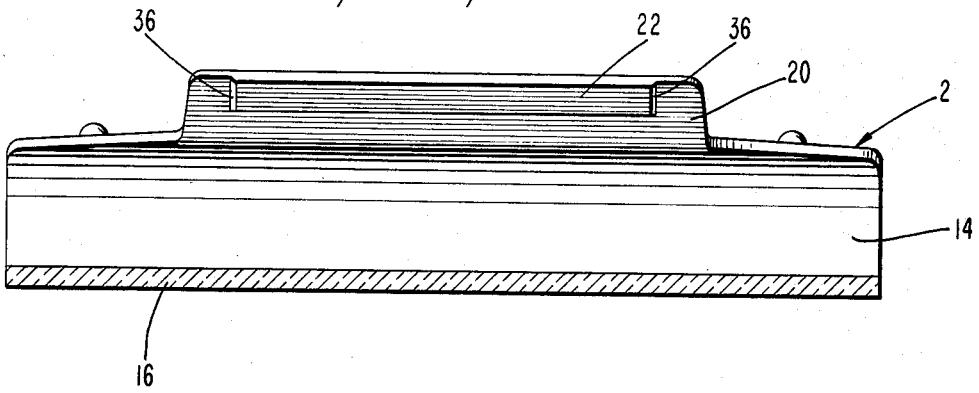
FIG. 4 is a cross-sectional view of the sleeve of FIG. 2 taken along lines 4—4.

As mentioned above, in a preferred embodiment of the present invention, a rib 22 is provided on the interior surface of flange 20 of curved side wall 16; the particular shape of rib 22 is best shown in FIG. 4. The function of rib 22 is to ensure that sleeve 2 remains securely on place on razor arm 6 once the sleeve had been positioned onto the razor. This is accomplished in that the rib 22 will be positioned between struts 28 and 30 of arm 6 when the sleeve is in place on the razor. Thus, the exposed edges 36 of rib 22 will contact the inner sides of struts 28 and 30 such that the sleeve can only be removed if sufficient effort is exerted longitudinally on the sleeve to overcome the interlocking of edges 36 with the sides of struts 28 and 30.

To remove sleeve 2 once it has been fitted onto razor 4, it is only necessary to exert sufficient longitudinal force on the sleeve relative the razor so as to overcome the locking action of edges 36 of rib 22 with struts 28 and 30 and the friction created by the engagement of resilient flanges 18 and 20 with razor arm 6. Once this is done, the sleeve can be slid off the arm, thereby freeing blade-carrying head 10 and permitting normal use of the razor.

The interlocking feature of the present invention will now be described in detail. This is best illustrated by FIG. 5 which shows a plurality of razors stacked one above the other for display, shipment or sale purposes, each razor having been provided with a protective sleeve according to the present invention.

In actual practice, disposable safety razors are often stacked and secured by means of package which couples together the handles 8 of each of the razors. This can be done, for example, by providing a slot longitudinally through the handle of each razor, aligning the slots of the stacked razors and then positioning a portion of the razor package through all of the aligned slots; such a package is the subject of U.S. patent application Ser. No. 59,728 filed June 16, 1980 by the present applicant, entitled "Package for Slotted Razors", and herein incorporated by reference. However,it should be appreciated that the interlocking feature of the present invention can be used with any package for holding a plurality of razors in which the razors are aligned and stacked vertically one atop the other.

Figure 5:
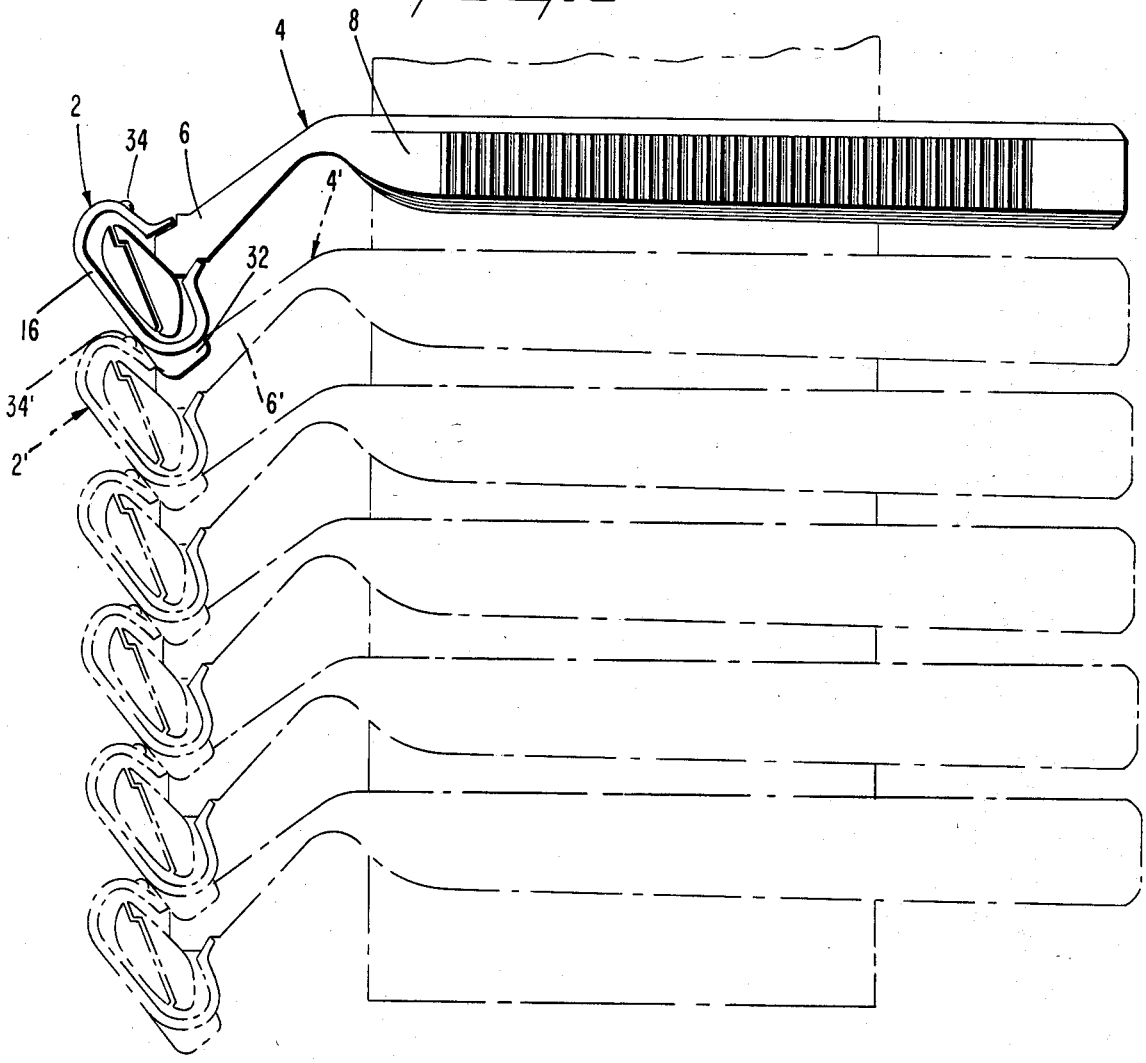
FIG. 5 is a side elevational view of a sleeve of FIG. 1 fitted on a plurality of disposable safety razors which have been stacked atop each other.

Turning now to FIG. 5, by stacking the razors with sleeves according to the present invention positioned thereon, tabs 32 of sleeve 2 of a first razor 4 come into contact with and straddle the arm 6' of the adjacent razor 4', thereby interlocking sleeve 2 with razor 4'. Accordingly, sleeve 2 cannot be prematurely removed from razor 4 due to this interlocking feature. Furthermore, transverse movement of razors 4 and 4' relative each other is substantially reduced by the engagement of arm 6' between tabs 32 of the sleeve 2 of razor 4.

At the same time, protrusions 34' of sleeve 2' on razor 4' come into contact with planar top wall 16 of sleeve 2 of razor 4; this contact serves to stabilize the razors when stacked in the manner illustrated and assist in reducing movement between razors 4 and 4'. Accordingly, movement of razors 4 and 4' relative one another is substantially reduced by the combined effect of the interlocking feature provided by tabs 32 and the stabilizing feature of protrusions 34'. In a similar fashion, all of the other stacked razors shown in FIG. 5 which have been provided with sleeves according to the present invention will likewise be engaged to one another so as to substantially reduce the possibility of any movement whatsoever within the entire array while preventing premature removal of the sleeves from any of the stacked razors.

It can be appreciated from the foregoing that the present invention provides protection of the pivotable blade-carrying head of a disposable safety razor without adversely affecting the pivoting mechanism that is a critical feature of such razors. This is accomplished by securing the protective sleeve to the rigid arm of the razor instead of to the head, itself; in this way, no contact is made between the sleeve and the head so that the latter is free to remain in its neutral detent position and is not loaded by the sleeve. The present invention also provides for interlocking of razors which have been stacked for purposes of shipment, display or sale thereby preventing premature removal of a sleeve as well as avoiding movement of the razors relative each other. This is accomplished by interengagement of the locking tabs of the sleeve of a first razor with the arm of an adjacent second razor, as well as contact between the nipple-shaped protrusions of the sleeve of the second razor with the planar top wall of the sleeve of the first razor.

The sleeves can fit a wide variety of razors by adapting the geometry of the sleeve to correspond to the dimensions of the blade-carrying head and supporting arm of the razor. Furthermore, the sleeve may be made of a variety of materials, any of which is capable of providing resilient engagement between the walls of the sleeve and the arm of the safety razor. It should also be appreciated that changes can be made with regard to the particular arrangement of elements comprising the sleeve while retaining the essential function and operation thereof; for example, a rib 22 could be provided on either one or both flanges 18 and 20, or the positioning of tabs 32 and protrusions 34 on side walls 12 and 14, respectively, could be reversed.

Inasmuch as the present invention is subject to many variations, modifications and changes in detail, it is intended that all matter contained in the foregoing description or shown in the accompanying drawings shall be interpreted as illustrative and not in a limiting sense.

What is claimed is:

1. A razor assembly comprising:

a handle;

a blade-carrying head attached to one end of said handle;

a body portion having a generally elliptical cross-section, formed by two inwardly-curved opposing sidewalls presenting two pairs of opposing edges, said sidewalls being joined along a first one of said two pairs of opposing edges by a top wall, said body portion being dimensioned to ensheath said blade-carrying head without touching said blade-carrying head;

a pair of recesses, disposed on said handle adjacent said blade-carrying head, for securing said body portion to said handle; and a pair of flanges, extending respectively from each of a second one of said pairs of opposing edges of said sidewalls, for engaging said recesses and so for releasably securing said body portion on said handle and supporting said body portion everywhere spaced away from said blade-carrying head so that force applied to said body portion is transmitted exclusively to said handle and not to said blade-carrying head.

2. The razor assembly according to claim 1 wherein an outer surface of one of said curved side walls of said body portion includes means for engaging a handle of a like-configured razor assembly of like configuration to said razor assembly when said razor assembly is stacked atop said like-configured razor assembly parallel and adjacent said like-configured razor assembly, thereby preventing removal of the said sleeve from said razor assembly while reducing lateral movement of said razor assembly and said like-configured razor assembly relative to each other.

3. The razor assembly according to claim 2 wherein said blade-carrying head of said razor assembly is attached to said handle by an arm, and wherein said engaging means includes a first tab secured to and extending from said outer surface of said one of said curved side walls of said razor assembly, so that said tab engages an arm of said like-configured razor assembly, when said razor assembly is stacked atop said like-configured razor assembly, . parallel and adjacent to said like-configured razor assembly.

4. The razor assembly according to claim 3 further including a second tab secured to and extending from said outer surface of said one of said curved side walls of said razor assembly, said first and second tabs being separated by a distance equal to the transverse dimension of said arm, so that said arm of said like-configured razor assembly is entrapped between said first and second tabs when said razor assembly is stacked atop said like-configured razor assembly, parallel and adjacent to said like-configured razor assembly.

5. The razor assembly according to claim 1, wherein said blade-carrying head is pivotably attached to said handle, wherein said body portion is dimensioned to ensheathe said blade-carrying head without touching said blade-carrying head over an entire range of pivoting of said blade-carrying head, and wherein said flange is for supporting said body portion out of contact with said blade-carrying head over said range.

6. The razor according to claim 1 wherein at least one of said flanges has a raised rib.

7. A sleeve for a disposable safety razor having a handle with a blade-carrying head attached thereto, comprising:

a body portion having a generally elliptical cross-section defining an outer surface and an interior, formed by two inwardly-curved opposing side walls presenting two pairs of opposing edges, said side walls being joined along a first one of said two pairs of opposing edges by a top wall to define a handle-receiving gap between a second one of said two pairs of opposing edges of said side walls, the outer surface of one of said curved side walls of said body portion including means for engaging the handle of a second disposable safety razor when the first razor is stacked atop a second razor parallel and adjacent thereto, so as to prevent removal of the sleeve from the first razor while reducing lateral movement of the razors relative each other, at least one outwardly-directed protrusion positioned on the outer surface of the other one of said curved side walls so that said protrusion on a sleeve secured to the second razor contacts the planar top wall of the sleeve secured to the first razor when the first razor is stacked atop the second razor parallel and adjacent thereto; and means for securing said body portion about the blade-carrying head by contact exclusively between said body portion and the handle, thereby protectively enveloping the blade-carrying head freely within the interior of said body portion so as to transmit any stress effected upon the sleeve directly to the handle of the razor.

* * * * *